US005797499A

United States Patent [19]

Pinco

[11] Patent Number: 5,797,499

[45] Date of Patent: Aug. 25, 1998

[54] CASKET DISPLAY SYSTEM AND CONSTRUCTION METHOD

[75] Inventor: Frank Pinco, Staten Island, N.Y.

[73] Assignee: South Brooklyn Casket Co., Inc., Brooklyn, N.Y.

[21] Appl. No.: 709,806

[22] Filed: Sep. 10, 1996

[51] Int. Cl.[6] ..... A47F 7/00

[52] U.S. Cl. ..... 211/13.1; 211/193; 211/175; 27/27

[58] Field of Search ..... 211/13.1, 189, 211/175, 193, 202; 248/127; 27/27

[56] References Cited

U.S. PATENT DOCUMENTS

| | | | |
|---|---|---|---|
| 1,841,412 | 1/1932 | Leicht . | |
| 2,937,768 | 5/1960 | Davis . | |
| 4,397,432 | 8/1983 | Resetar | 211/193 X |
| 5,054,404 | 10/1991 | Melgers | 211/193 X |
| 5,405,017 | 4/1995 | Szabo . | |
| 5,520,293 | 5/1996 | Hartley | 248/127 X |
| 5,611,442 | 3/1997 | Howard | 211/189 X |

*Primary Examiner*—Robert W. Gibson, Jr.
*Attorney, Agent, or Firm*—Schweitzer Cornman Gross & Bondell LLP

[57] ABSTRACT

A casket display system having an enclosure with two side walls and a back wall, and having a casket support structure supported by the side walls. The casket support structure includes a fixed support for an upper casket and a movable support for a lower casket. The fixed support for the upper casket includes cantilever arms mounted on upper horizontal support members which extend between the upper and lower caskets and are supported by the side walls. The movable casket support has a dolly and a scissor mechanism. The scissor mechanism is mounted to a lower horizontal support member which is connected the side walls. The side walls include internal support structure which support the casket support structure and include floor-engaging portions which extend beyond the cantilever arms to provide support for the upper casket beyond it center of gravity. A hydraulic actuator can operate the movable casket support.

22 Claims, 6 Drawing Sheets

CASKET DISPLAY SYSTEM AND CONSTRUCTION METHOD

FIELD OF THE INVENTION

This invention pertains to the field of casket display systems and, in particular, to casket display systems having two-tiered casket racks partially surrounded by side and back walls.

BACKGROUND OF THE INVENTION

Caskets are typically viewed in display rooms wherein they are stacked such that the available space may be used efficiently.

U.S. Pat. No. 1,841,412 to Leicht discloses a two-tiered, free-standing rack which can support an upper and lower casket. The upper casket is supported in a fixed position on cantilever arms, which are fixed by their extreme back ends to vertical support posts. This configuration is necessary in this type of prior art design to allow the lower casket to slide under the upper casket. The lower casket is supported on two independent sliding arms which are supported on rollers. While the Leicht device does improve efficiency, since the supporting arms are independent, the casket can rotate undesirably during movement. Also, the casket must be moved manually from near its center. Moreover, since the cantilever arms can only be supported at their extreme back ends, the amount of weight that they can bear is significantly limited.

U.S. Pat. No. 2,937,768 to Davis discloses a two-tiered, free-standing rack which can support and upper and lower casket. As with Leicht, the upper casket of the Davis device is supported in a fixed position on cantilever arms. Also, as above, the cantilever arms are necessarily fixed only at their extreme back ends to vertical support posts. The lower casket, however, is supported on a movable dolly connected to the rack by a scissor-arm linkage. The scissor linkage has four arms which allow the lower casket to be rolled out from underneath the upper casket a sufficient distance to be opened and viewed from all sides. After viewing, the lower casket can be rolled back underneath the upper casket. This prior design does improve the use of floor space within a display room, however, unless it is guided, the casket may drift laterally and/or rotate as it is moved. (In fact, this design is capable of lateral movement of more than 8 inches.) This is undesirable because the person manipulating the casket may not always be in a position to properly guide the casket. And, if the casket is not properly guided, the scissor linkage may jam. Also, as above, this prior scissor design must be manipulated manually, usually by applying pressure to the lower casket itself. Moreover, the single point support for the cantilever arms significantly limits the amount of weight which they can bear.

U.S. Pat. No. 5,405,017 to Szabo discloses a casket display system which combines the Davis rack system described above with an enclosure formed of two side walls connected to a back panel or wall. The enclosure of Szabo provides an appropriate backdrop for displaying caskets, however it provides no structural support for the rack. Therefore, a free-standing rack, such as is disclosed by Davis (with its accompanying undesirable movement and weight limitations), is still required.

Therefore, what is desired is a casket display system with an enclosure that provides support for an automatically-operable, two-tired casket display rack having a movable support for a lower casket where the movable support prevents the lower casket from drifting or rotating during movement, and having cantilever arms to support an upper casket of increased weight.

SUMMARY OF THE INVENTION

Accordingly, it is an object of the present invention to provide a casket display system having an enclosure which supports a two-tiered casket display rack.

It is another object of the present invention to provide a casket display system of the above character with support structure associated with the side walls which supports an upper casket on cantilever arms.

It is yet another object of the present invention to provide a casket display system of the above character with a fixed support for an upper casket having cantilever arms connected to horizontal support means supported by vertical support means associated with the side walls.

It is still another object of the present invention to provide a casket display system of the above character with a horizontal support means which support cantilever arms at a point between the upper and lower caskets.

It is yet still another object of the present invention to provide a casket display system of the above character with side walls having floor supports extending beyond the center of gravity of the upper casket.

It is another object of the present invention to provide a casket display system of the above character with a rack having a movable support for a lower casket which prevents the lower casket from drifting or rotating during movement.

It is another object of the present invention to provide a casket display system of the above character with a movable support for a lower casket having two scissor arms connected to a dolly.

It is another object of the present invention to provide a casket display system of the above character with a scissor mechanism which may be operated automatically.

It is another object of the present invention to provide a method to construct a casket display system of the above character.

These and other objects are realized by the casket display system of the present invention having a back wall, two side walls connected to the back wall, upper and lower horizontal supports connected between the side walls, cantilever arms connected to the upper horizontal support for supporting an upper casket, a movable casket support connected to the lower horizontal support wherein each side wall has a floor-engaging support extending beyond the cantilever arms for supporting the upper casket beyond its center of gravity.

BRIEF DESCRIPTION OF THE DRAWINGS

For a complete understanding of the above and other features and advantages of the invention, reference should be made to the following detailed description of the preferred embodiments of the invention and to the accompanying drawings wherein.

DETAILED DESCRIPTION OF THE INVENTION

Figure 1:
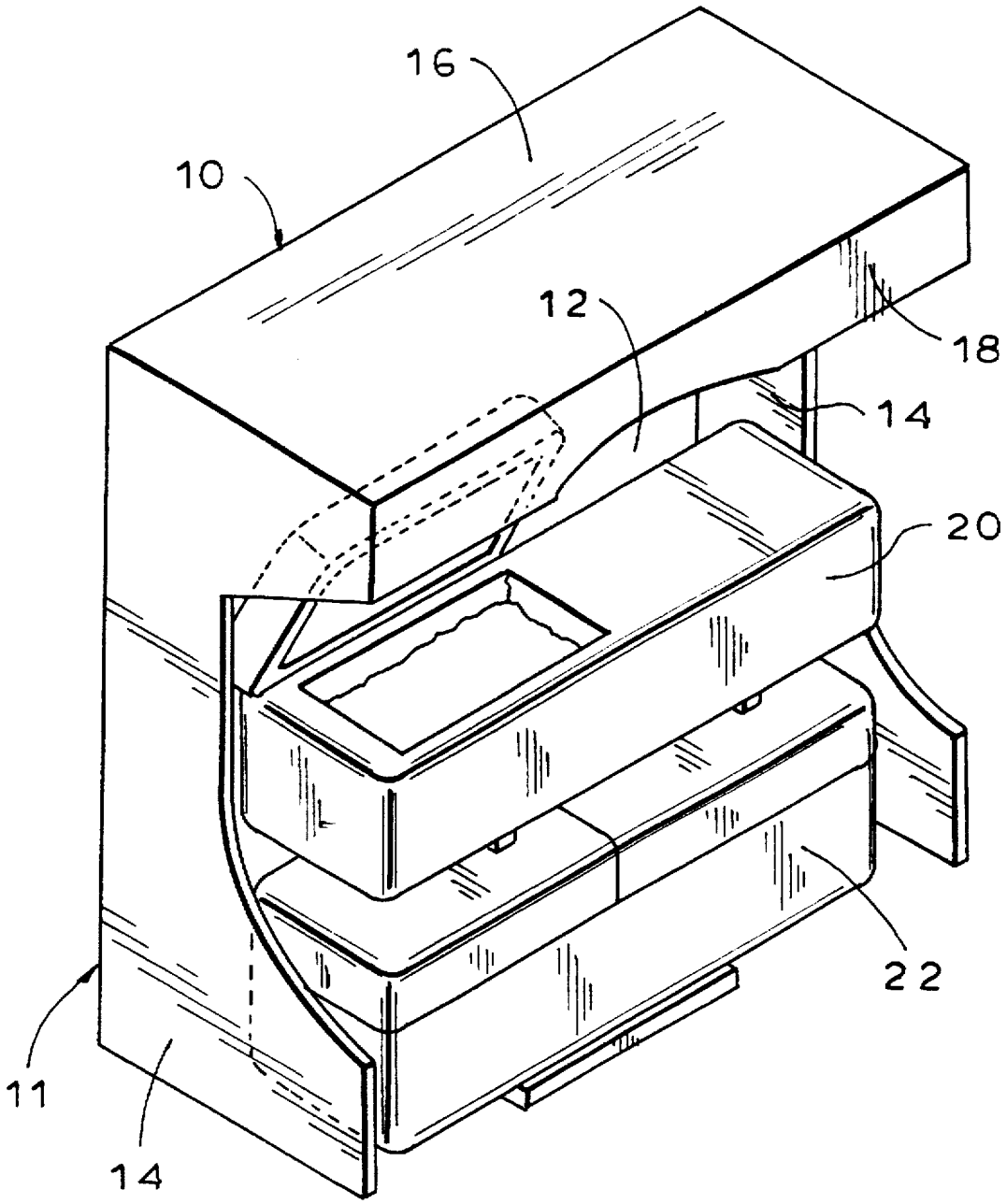
FIG. 1 is a perspective view of the casket display system of the present invention.

Referring to FIG. 1, a casket display system 10 according to the present invention includes an enclosure 11 formed by a back wall 12 and two side walls 14. The side walls 14 preferably have the general shape of a rectangle with a scalloped, or cut-out portion 72 which provides for improved viewing of the caskets from the side and rear (see FIGS. 1 and 2). Preferably, the enclosure 11 also includes a top 16, a soffit or valance 18 and lighting (not shown). The casket display system 10 supports an upper casket 20 on fixed cantilever arms (hidden) and a lower casket 22 on a movable casket support (also hidden). Here, the lower casket 22 is shown in the fully retracted position.

Figure 2:
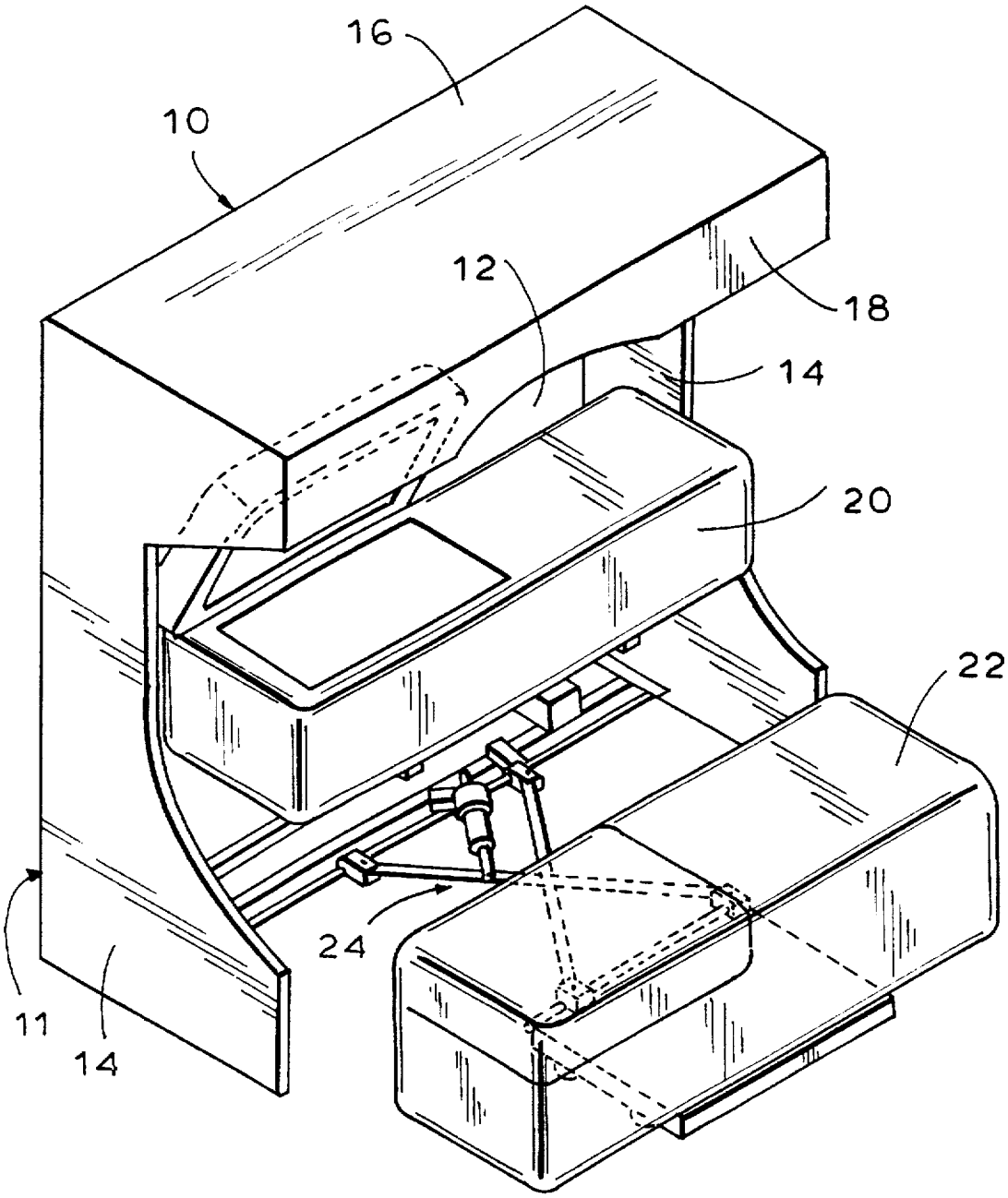
FIG. 2 is a perspective view of the casket display system of FIG. 1 showing the lower casket in an extended position.

Referring to FIG. 2, a movable casket support 24 (partially hidden) allows the lower casket 22 to be moved out from under the upper casket 20 such that the lower casket 22 may be opened and viewed from all sides. When desired, the lower casket 22 may be retracted to a position directly under the upper casket 20.

Figure 3A:
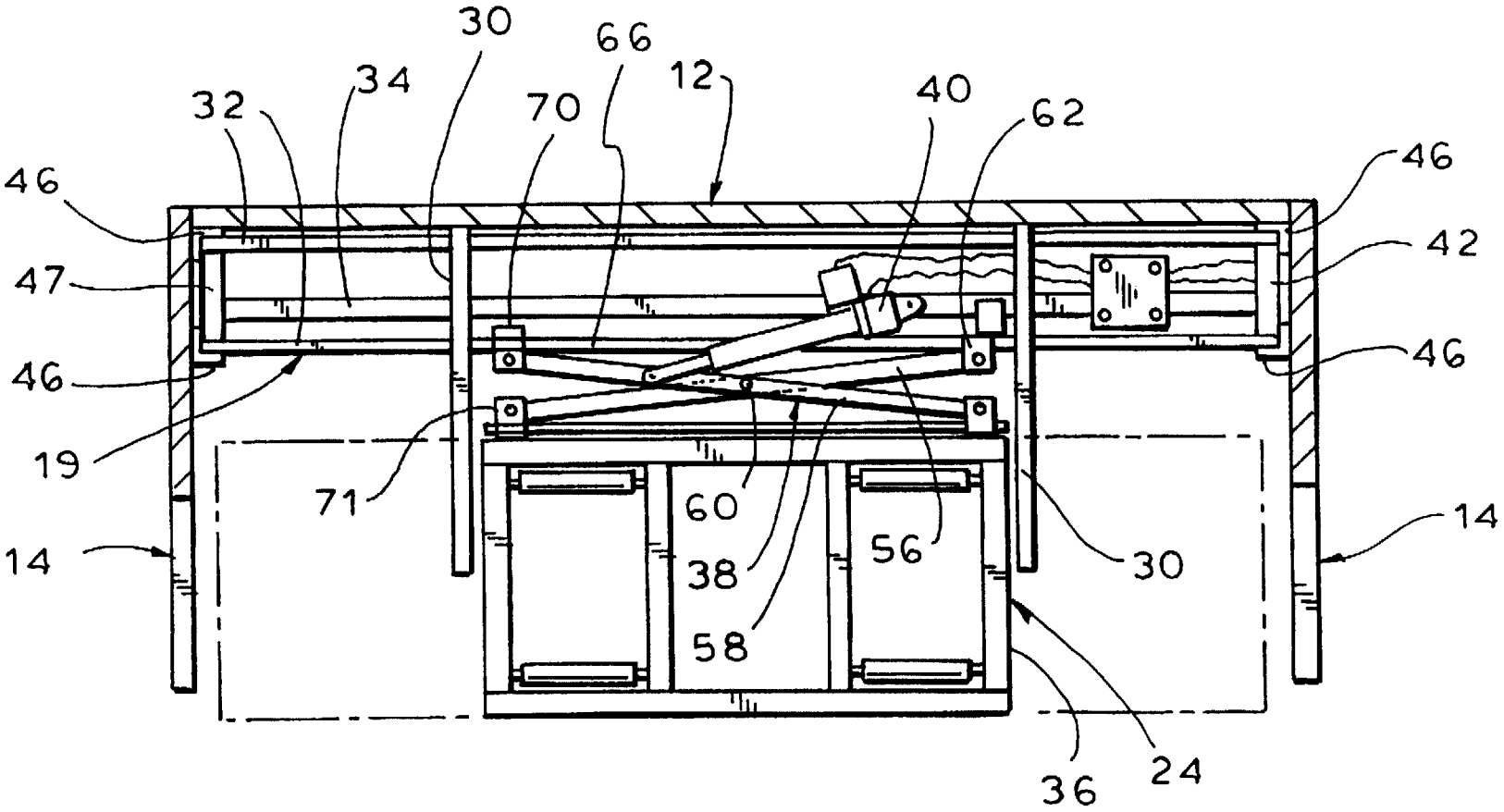
FIGS. 3A and 3B are plan views of the casket display system of FIG. 1 showing the casket support structure the dolly and scissor mechanism being in retracted and extended positions, respectively.
Figure 3B:
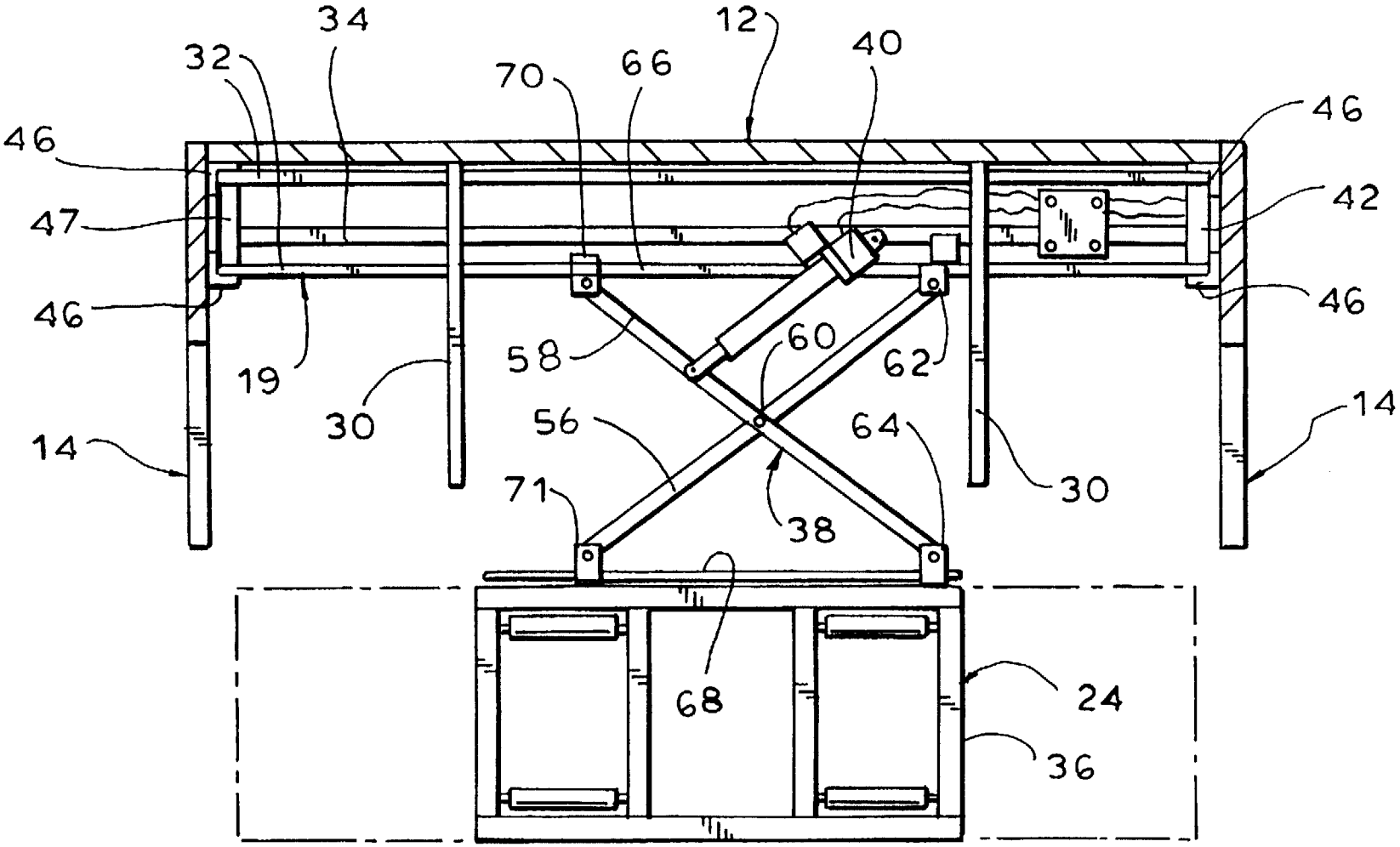

Referring to FIGS. 3A and 3B, a casket support structure 19 includes cantilever arms 30 which extend outward from spaced-apart upper horizontal support members 32 forming a substantially invisible support for the upper casket 20 (see FIGS. 1 and 2). At least one of the horizontal support members 32 extends between the upper casket and lower casket 22 (when retracted). This reduces the length of the cantilevered portion of cantilever arms 30 thereby increasing the weight which they can bear. The cantilever arms 30 extend over the lower casket 22 (when retracted) and are spaced-apart a distance that is substantially less than the length of the upper casket 20.

Connected to a lower horizontal support member 34 is the movable casket support 24 which preferably comprises a dolly 36 and a scissor mechanism 38. Preferably, an actuator 40, such as an hydraulic actuator, is connected to the scissor mechanism 38 to operate the movable casket support 24 automatically.

Figure 4:
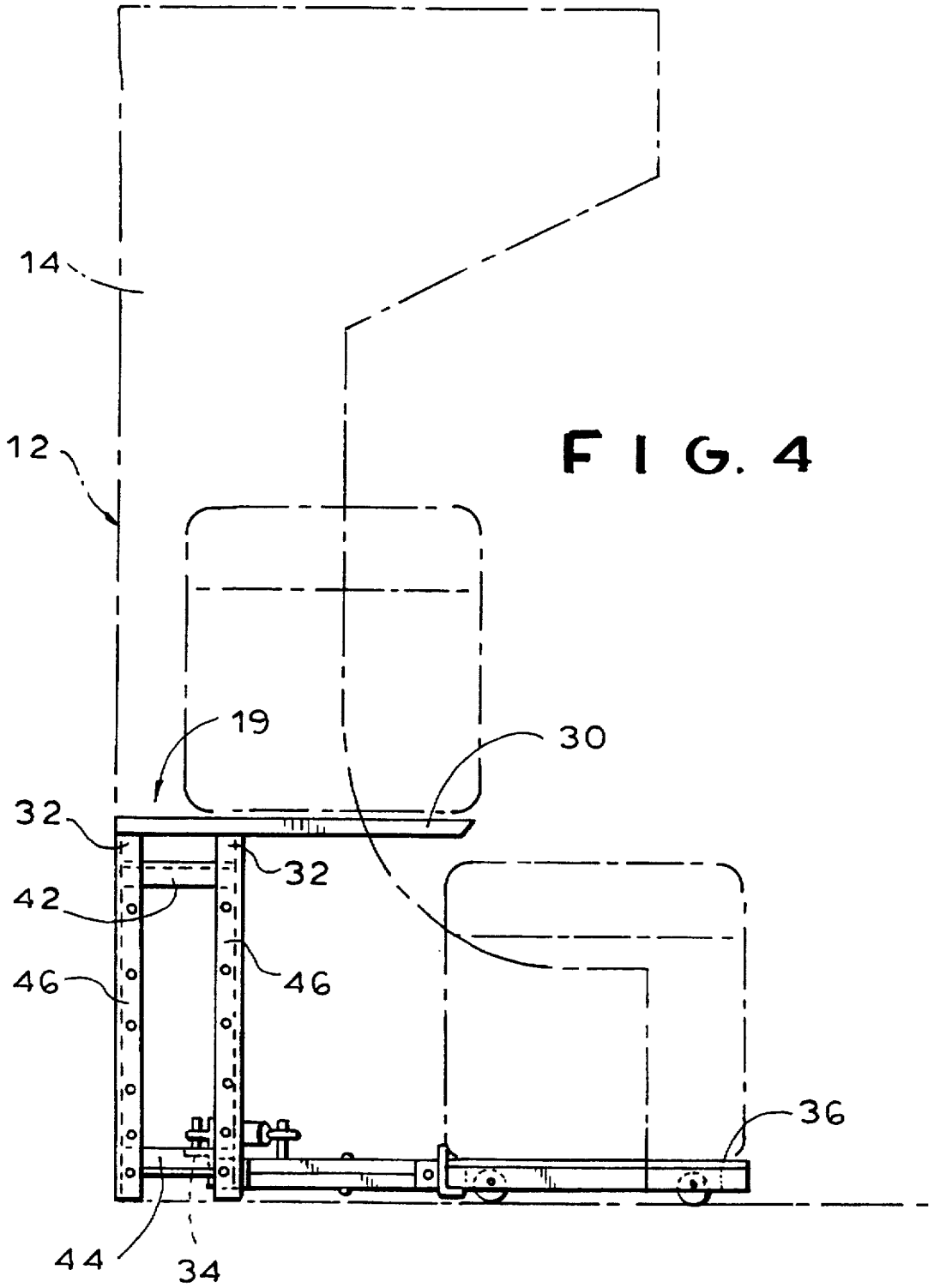
FIG. 4 side elevation view of the casket display system of FIG. 1, showing the casket support structure.

Referring to FIGS. 3A and 3B and 4, the upper and lower horizontal support members 32, 34 are preferably supported by upper and lower cross bars 42, 44, respectively. The cross bars 42, 44 are connected to external, vertical support members 46, forming the casket support structure 19. The casket support structure 19 is then placed between the side walls 14 and secured thereto, forming the casket display system 10. Preferably, the components of the casket support structure 19 are steel and are welded together to form a rigid frame. In this manner, the casket support structure 19 may be substantially fabricated prior to arrival at the site of assembly. Once the side walls 14 are secured to the back wall 12, the prefabricated casket support structure 19 can then simply be aligned between the side walls 14 and secured in place.

It should be appreciated that the base formed by the external, vertical support members 46 is insufficient, by itself, to support the casket support structure 19. This is because the external, vertical support members 46 are all located on one side of the center of the cantilever arms. This is necessary to prevent the casket support structure from being visible through the cut-out portion 72 in the side walls 14. The external, vertical support members 46 contact the floor and provide adequate vertical support for the upper casket, however, since they are all located to one side of the center of the cantilever arms, any load placed thereon may cause the casket support structure 19 to topple over. Therefore, the casket support structure 19 of the present invention requires additional support which is supplied by the side walls 14.

Figure 5:
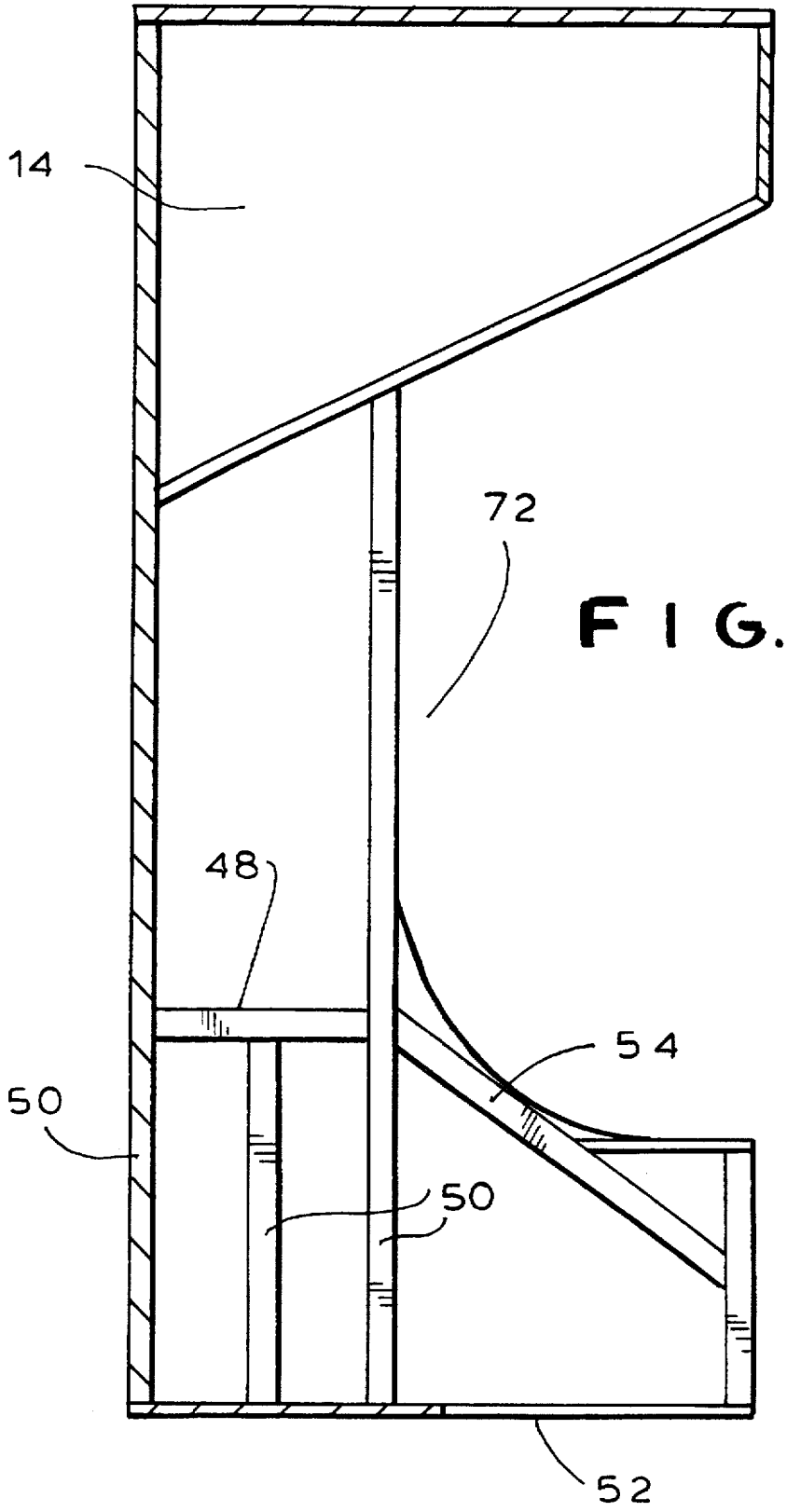
FIG. 5 is a side elevation view of the casket display system of FIG. 1, showing the internal support structure within the interior of the side walls.

Referring to FIG. 5, the side walls 14 preferably include internal support structure, generally referred to as 48. The internal support structure 48 is preferably comprised of wood, however any suitable material is acceptable. Preferably, the internal support structure 48 includes internal vertical members 50 which align with the external, vertical support members 46 (not shown) of the casket support structure 19 (also not shown) and preferably a floor-engaging portion 52 extends beyond the cantilever arms 30 (see also FIG. 4) to provide support for the upper casket, resting thereon. The floor-engaging portions 52 extend beyond the cantilever arms 30 to ensure that the casket display system 10 provides support for the upper casket on both sides of the center of gravity thereof. That is, to ensure that the casket display system 10 is stable regardless of where the upper casket 20 is placed on the cantilever arms 30.

The floor-engaging portion 52 is preferably reinforced by a strut 54, in the internal support structure 48 of the side walls 14. The floor-engaging portions 52, in combination with the other components of the internal support structure 19, provide the additional support required for the casket support structure 19.

In another embodiment (not shown), the internal support structure 48 of the side walls may include internal load-bearing vertical members which can directly support both the vertical load of the upper casket and the horizontal load of the lower casket. In this alternative embodiment, the casket support structure 19 need not include the external, vertical support members 46. Instead, the upper and lower horizontal support members 32, 34 can connect (preferably directly) to the internal load-bearing vertical members within the side walls. The internal load-bearing vertical members are preferably steel and are positioned to transmit forces applied thereto to the floor, such as through direct contact with the floor or through an underlying base.

Referring again to FIGS. 3A and 3B, the scissor mechanism 38 of the movable casket support 24 is preferably connected between the lower horizontal support member 34 and the dolly 36. Preferably, the scissor mechanism 38 has first and second arms 56, 58 which are pivotally connected to one another near their centers 60. The first arm 56 has an end 62 which is pivotally connected to the lower horizontal support member. The second arm 58 has an end 64 which is pivotally connected to the dolly 36. The scissor mechanism 38 also includes two slide bars 66, 68. One slide bar 66 is connected to the lower horizontal support member 34. The other slide bar 68 is connected to the dolly 36. The first and second arms 56, 58 are connected to the slide bars 68, 66, respectively, by sliding collars 70, 71.

The dimensions and composition of the components of the scissor mechanism 38, along with the tolerances observed in their assembly, prevent the movable casket support 24 (and the lower casket 22 thereon) from drifting and/or rotating during movement. The components are preferably comprised of rigid steel and are formed to resist and minimize any deflection or bending caused by the forces required to move the dolly 36 when under load. The arms 56, 58 are preferably approximately 46 inches long, and are comprised of 1"×2", 11 gauge, rectangular hollow tubes. The slide rods 66, 68 are preferably solid steel rods with crosssections of approximately 9/16ths of an inch. Preferably, the slide rods 66, 68 are of the minimum length to provide full extension of the scissor mechanism 38 so that the deflection caused therein by forces applied through the arms 56, 58 is minimized. Alternatively, the slide rods 66, 68 can be supported intermediate their ends to minimize deflection caused by such forces while allowing the scissor mechanism 38 to extend fully. Also, preferably, the actuator 40 is connected to the pivot end 64 of the second arm 58 or to the collar 70 is attached thereto to minimize bending forces applied the second arm 58.

It should be understood, of course, that the specific form of the invention herein illustrated and described is intended to be representative only. In this respect, the specific form of the casket display system employing a casket support structure supported by the side walls of an enclosure can take any of a variety of forms. Accordingly, reference should be made to the following appended claims in determining the full scope of the invention.

What is claimed is:

1. A casket display system for displaying an upper and lower casket comprising:

a back wall;

two side walls connected to said back wall;

an upper horizontal support connected between said side walls, a portion of said upper horizontal support being spaced from said back wall and extending between the upper and lower caskets;

cantilever arms connected to said upper horizontal support for supporting the upper casket;

a movable casket support for the lower casket; and each side wall having a floor-engaging support extending beyond said cantilever arms for supporting the upper casket beyond its center of gravity.

2. A casket display system as in claim 1 wherein each side wall further comprises an internal support structure within a periphery thereof, said internal support structure being connected to and providing reinforcement for said floor-engaging support.

3. A casket display system as in claim 2:

further comprising a lower horizontal support connected between said side walls; and wherein said movable casket support is connected to said lower horizontal support.

4. A casket display system as in claim 3 wherein said movable casket support further comprises a dolly connected to said lower horizontal support by a scissor mechanism.

5. A casket display system as in claim 4 wherein the scissor mechanism further comprises first and second arms pivotally connected to one another, said first arm having an end pivotally connected to said lower horizontal support, and said second arm having an end pivotally connected to said dolly.

6. A casket display system as in claim 5 further comprising an actuator connected to said scissor mechanism for automatically moving the lower casket.

7. A casket display system as in claim 6 wherein said actuator further comprises a hydraulic piston having a first end connected to said second arm of the scissor mechanism and a second end connected to said lower horizontal support.

8. A casket display system as in claim 3:

further comprising external, vertical, floor-engaging members connected to said internal support structure of each side wall; and wherein said upper and lower horizontal supports are supported by said external, vertical floor-engaging members.

9. A casket display system as in claim 3 wherein:

said internal support structure includes internal members positioned to transmit force applied thereto to the floor; and said upper and lower horizontal supports are supported by said internal members.

10. A casket display system as in claims 8 wherein said upper horizontal support further comprises two horizontally spaced-apart bars, wherein one of said two horizontally spaced-apart bars extends between the upper and lower caskets, and wherein said cantilever arms are connected across both of said bars.

11. A casket display system as in claims 9 wherein said upper horizontal support further comprises two horizontally spaced-apart bars, wherein one of said two horizontally spaced-apart bars extends between the upper and lower caskets, and wherein said cantilever arms are connected across both of said bars.

12. A casket display system as in claim 7:

further comprising external, vertical, floor-engaging members connected to said internal support structure of each side wall; and wherein said upper and lower horizontal supports are supported by said external, vertical floor-engaging members.

13. A casket display system as in claim 7 wherein:

said internal support structure includes internal members positioned to transmit force applied thereto to the floor; and said upper and lower horizontal supports are supported by said internal members.

14. A casket display system as in claims 12 wherein said upper horizontal support further comprises two horizontally spaced-apart bars, wherein one of said two horizontally spaced-apart bars extends between the upper and lower caskets, and wherein said cantilever arms are connected across both of said bars.

15. A casket display system as in claims 13 wherein said upper horizontal support further comprises two horizontally spaced-apart bars, wherein one of said two horizontally spaced-apart bars extends between the upper and lower caskets, and wherein said cantilever arms are connected across both of said bars.

16. An automatic casket display system for displaying an upper and lower casket comprising:

a back wall;

two side walls connected to said back wall, each side wall having an internal support structure within a periphery thereof and having a floor-engaging support connected to and reinforced by said internal support structure;

external, vertical, floor-engaging members connected to said internal support structure of said side walls;

upper and lower horizontal supports connected between said side walls, said upper and lower horizontal supports being supported by said external, vertical, floor-engaging members;

a portion of said upper horizontal support being spaced from said back wall and extending between the upper and lower caskets;

cantilever arms depending from said upper horizontal support for supporting an upper casket;

a dolly for supporting a lower casket, said dolly being connected to said lower horizontal support by a scissor mechanism;

said scissor mechanism having first and second arms pivotally connected to one another, said first arm having an end pivotally connected to said lower horizontal support and said second arm having an end pivotally connected to said dolly;

a hydraulic actuator having a first end connected to said lower horizontal support and a second end connected to said second arm of said scissor mechanism for moving the lower casket; and said floor-engaging supports of said side walls extending beyond said cantilever arms for supporting an upper casket beyond it center of gravity.

17. A method for constructing a casket display for upper and lower caskets comprising:

(a) providing a back wall;

(b) providing two side walls, each wall having an internal support structure with internal vertical wall members within a periphery thereof, and having a floor-engaging support rigidly connected to said internal support structures (c) connecting said side walls to said back wall;

(d) creating a two-tiered casket support structure by:

(i) providing two sets of steel vertical members;

(ii) providing four steel cross bar members;

(iii) fixing two steel cross bar members between each set of steel vertical members, said cross bar members being in upper and lower positions;

(iv) providing two steel upper horizontal support members;

(v) providing a steel lower horizontal support member;

(vi) fixing said upper horizontal support members between said upper cross bar members, said upper horizontal support members being spaced-apart horizontally and being substantially parallel;

(vii) fixing said lower horizontal support member between said lower cross bar members;

(viii) providing two steel cantilever arms;

(ix) fixing said cantilever arms substantially perpendicular across said upper horizontal support members;

(x) providing a movable casket support; and (xi) attaching said movable casket support to said lower horizontal support member;

(e) placing said casket support structure between said side walls in a position wherein said floor-engaging supports extend beyond said cantilever arms to support an upper casket beyond its center of gravity; and (f) securing said steel vertical members to said internal vertical wall members.

18. The method of claim 17 wherein the step of providing a movable casket support further comprises:

(a) providing a dolly;

(b) providing a scissor mechanism; and (c) connecting said scissor mechanism between said dolly and said lower horizontal support member.

19. The method of claim 18 wherein the step of providing a scissor mechanism further comprises:

(a) providing a first arm pivotally connected to said lower horizontal support member;

(b) providing a second arm pivotally connected to said dolly; and (c) pivotally connecting said first and second arms.

20. The method of claim 19 further comprising providing an actuator connected between said lower horizontal support member and said scissor mechanism.

21. The method of claim 20 wherein said step of providing an actuator further comprises providing a hydraulic actuator with a first end connected to said lower horizontal support member and a second end connected to said second arm of said scissor mechanism.

22. The method of claim 19 wherein the step of fixing said upper horizontal support members further comprises aligning at least one of said two steel upper horizontal members such that it extends between the upper and lower caskets.

* * * * *